US007086920B2

(12) United States Patent
Fusco

(10) Patent No.: US 7,086,920 B2
(45) Date of Patent: Aug. 8, 2006

(54) FOG FILLED BUBBLE BLOWER

(76) Inventor: Michael T. Fusco, 12 Matthew Dr., Johnston, RI (US) 02919

( * ) Notice: Subject to any disclaimer, the term of this patent is extended or adjusted under 35 U.S.C. 154(b) by 0 days.

(21) Appl. No.: 10/821,742

(22) Filed: Apr. 9, 2004

(65) Prior Publication Data

US 2004/0259458 A1 Dec. 23, 2004

Related U.S. Application Data

(60) Provisional application No. 60/461,599, filed on Apr. 9, 2003.

(51) Int. Cl.
*A63H 33/28* (2006.01)

(52) U.S. Cl. ..... 446/15; 446/24

(58) Field of Classification Search ..... 446/15–21, 446/24, 25, 176, 179, 177, 475
See application file for complete search history.

(56) References Cited

U.S. PATENT DOCUMENTS 2,324,359 A * 7/1943 Callan ..... 446/24
2,409,471 A * 10/1946 Brosseit ..... 446/24
2,566,296 A * 9/1951 Brosseit ..... 446/21
2,628,450 A * 2/1953 Shelton ..... 446/24
2,675,641 A * 4/1954 Baggott ..... 446/18
2,912,790 A * 11/1959 Weeber ..... 446/18
3,814,394 A * 6/1974 Murray ..... 261/83
5,205,771 A * 4/1993 Sims ..... 446/21
6,416,377 B1 * 7/2002 Bart ..... 446/15
6,421,502 B1 * 7/2002 Aronie et al. ..... 392/399
2002/0031977 A1 * 3/2002 Thai ..... 446/15
2005/0148276 A1 * 7/2005 LaFata et al. ..... 446/18

* cited by examiner

*Primary Examiner*—Faye Francis

(57) ABSTRACT

A fog filled bubble blower having a housing containing or attached to a battery box, exhaust fan, fog fluid reservoir, fog chamber, heating element assembly, electric motor, nozzle, and bubble wand, and switched circuits to operate the electric motor and heating element assembly. Fog fluid is placed in the fog fluid reservoir, which fog fluid reaches the heating element assembly, where it is vaporized in the fog chamber. The bubble wand is dipped into bubble solution, the exhaust fan is activated, sucking the fog out of the fog chamber and through the nozzle and out through the bubble wand. As the fog filled air passes through the wand, it forms a bubble which is filled with fog.

4 Claims, 7 Drawing Sheets

FOG FILLED BUBBLE BLOWER

CROSS-REFERENCE AND PRIORITY

Applicant references and claims the benefit of prior filed United States Provisional Patent Application Ser. No. 60/461,599, filed Apr. 9, 2003 and titled smoke filled bubble blower concept.

BACKGROUND

Bubble blowers are one of the oldest and most endeared toys of all time. Everyone has witnessed the joy of a child blowing bubbles and racing off to catch, or pop as many as possible mid flight. The invention described herein is meant to enhance this play pattern by increasing the visibility of bubbles by adding opacity and rewarding the child for popping bubble with visual stimulation.

Smoke or fog generating toys are well-known, such as those disclosed in U.S. Pat. Nos. 6,421,502, 2,628,450 and 2,324,359, as are bubble blowing devices. A few devices combine a smoke generating heat element with a bubble-blowing device, as disclosed in U.S. Pat. Nos. 5,205,771, 2,912,790 and 2,566,296. When a bubble is filled with artificial smoke, or fog, collectively referred to as "fog" in this application, it gives the bubble a solid appearance thus making it easy to see. Said bubble once popped will release its fog filled contents resulting in a billowing fog affect.

Known devices which add a fog generating heat element with a bubble-blowing device do not include a hand-held housing containing the energy source to heat the fog generating fluid, a motorized fan to generate the air flow to evacuate the fog chamber, efficient switching of the motorized fan and heating element to conserve energy, and a tapered nozzle connected to a bubble wand, where the generated fog can pass from the fog chamber, through the nozzle and bubble wand without being exposed to the outside air.

Known devices also do not use a motorized fan to evacuate the fog chamber by suction, or an exhaust feed tube and a fresh air intake tube for efficient and effective evacuation of the smoke chamber and filling of the bubble with fog.

SUMMARY OF THE INVENTION

The fog filled bubble blower 47 is comprised of a housing having a housing front 1 and housing back 2, which housing contains or is attached to a battery box 3, exhaust fan 9, fog fluid reservoir 12, fog chamber 13*a* & 13*b*, heating element assembly 18, electric motor 21, nozzle 11, bubble wand 14, and switching circuits to operate the electric motor and heating element assembly. Generally, and as is more specifically described below, fog fluid is placed in the fog fluid reservoir, which fog fluid reaches the heating element assembly 18, where it is vaporized in the fog chamber 13. The bubble wand 14 is dipped into bubble solution, the exhaust fan is activated, sucking the fog out of the fog chamber and through the nozzle 11 and out through the bubble wand. As the fog filled air passes through the wand, it forms a bubble which is filled with fog. In an alternative embodiment, the fog is blown out of the fog chamber through a tapered nozzle and bubble wand generally closed to outside air.

A heating element inside the fog chamber vaporizes fog fluid, consisting of lightweight oil for example, propylene glycol that varies in viscosity depending on the brand. When the vapors come into contact with cool air, they condense to form a colloid that consists of liquid droplets dispersed in air—in other words, a fog.

Colloids tend to stay suspended in air because each particle has some static electric charge. Since the particles are small and each of them repels the others, they do not quickly settle. Colloids look "smoky" because the suspended particles are large enough to scatter light.

The present invention further comprises a hand-held housing containing the energy source to heat the fog generating fluid, a motorized fan to generate the air flow to evacuate the fog chamber, efficient switching of the motorized fan and heating element to conserve energy, and a tapered nozzle connected to a bubble wand, where the generated fog can pass from the fog chamber, through the nozzle and bubble wand without being exposed to the outside air.

The present invention also comprises a motorized fan to evacuate the fog chamber by suction, an exhaust feed tube and a fresh air intake tube for efficient and effective evacuation of the smoke chamber and filling of the bubble with fog.

BRIEF DESCRIPTION OF DRAWINGS

These and other features, aspects and advantages of the present invention will become better understood with regard to the following description, appended claims, and accompanying drawings where:

DETAILED DESCRIPTION OF THE DISCLOSURE

Figure 1:
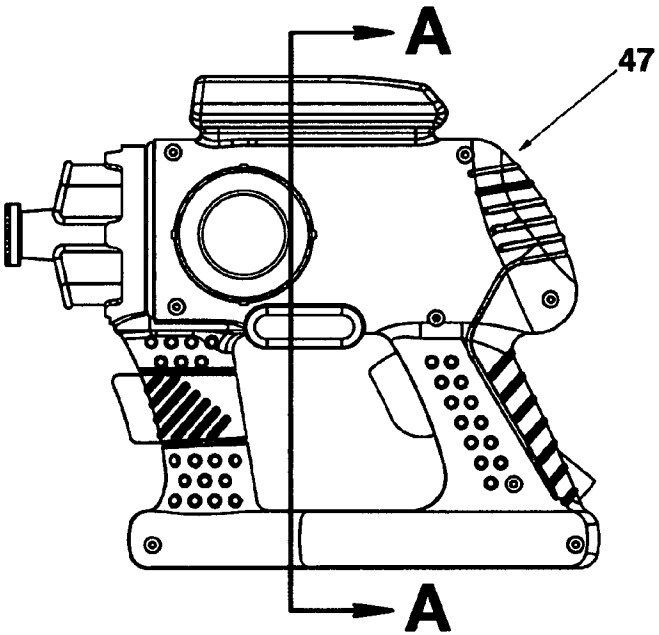
FIG. 1 shows a side view of an assembled fog filled bubble blower.
Figure 5:
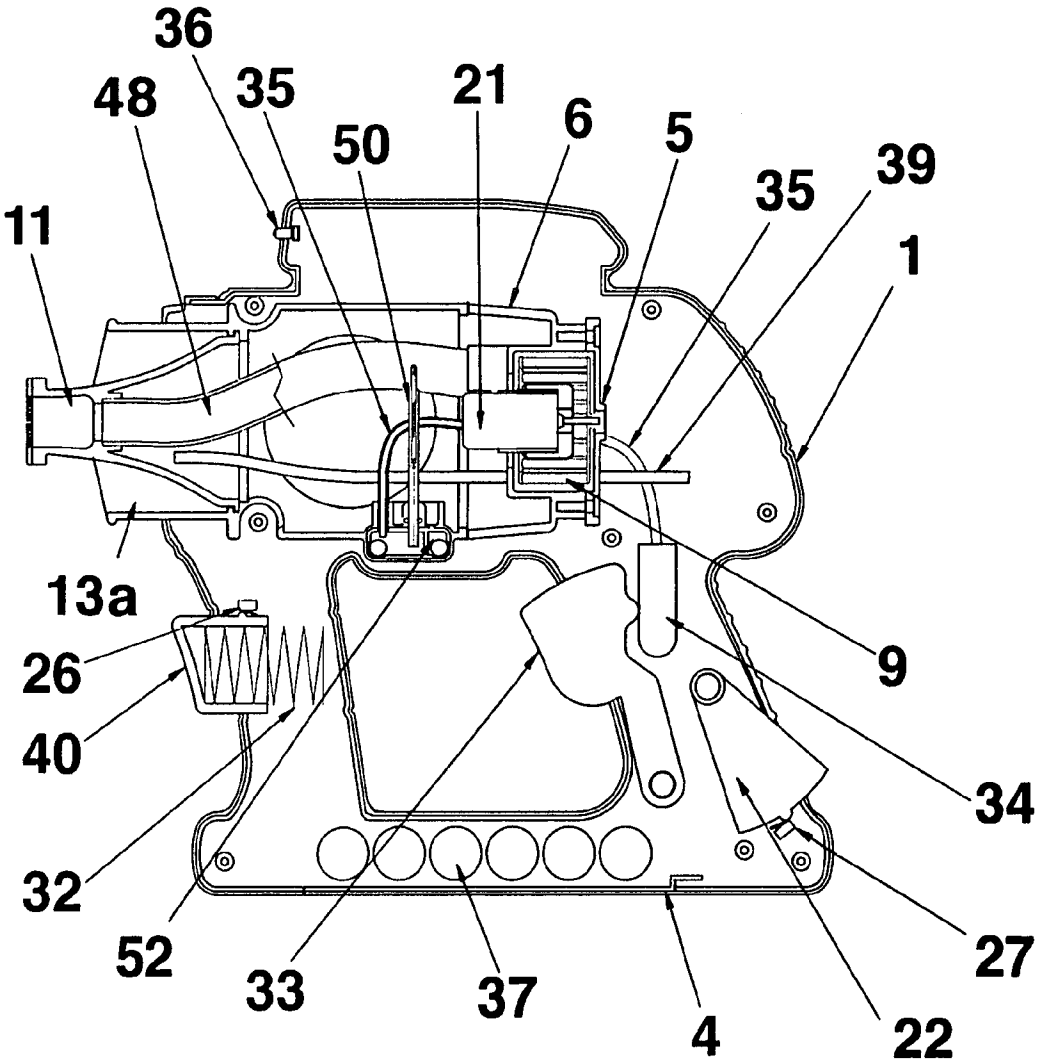
FIG. 5 shows a sectional view of the fog filled bubble blower along the line B–B' in FIG. 4.
Figure 6:
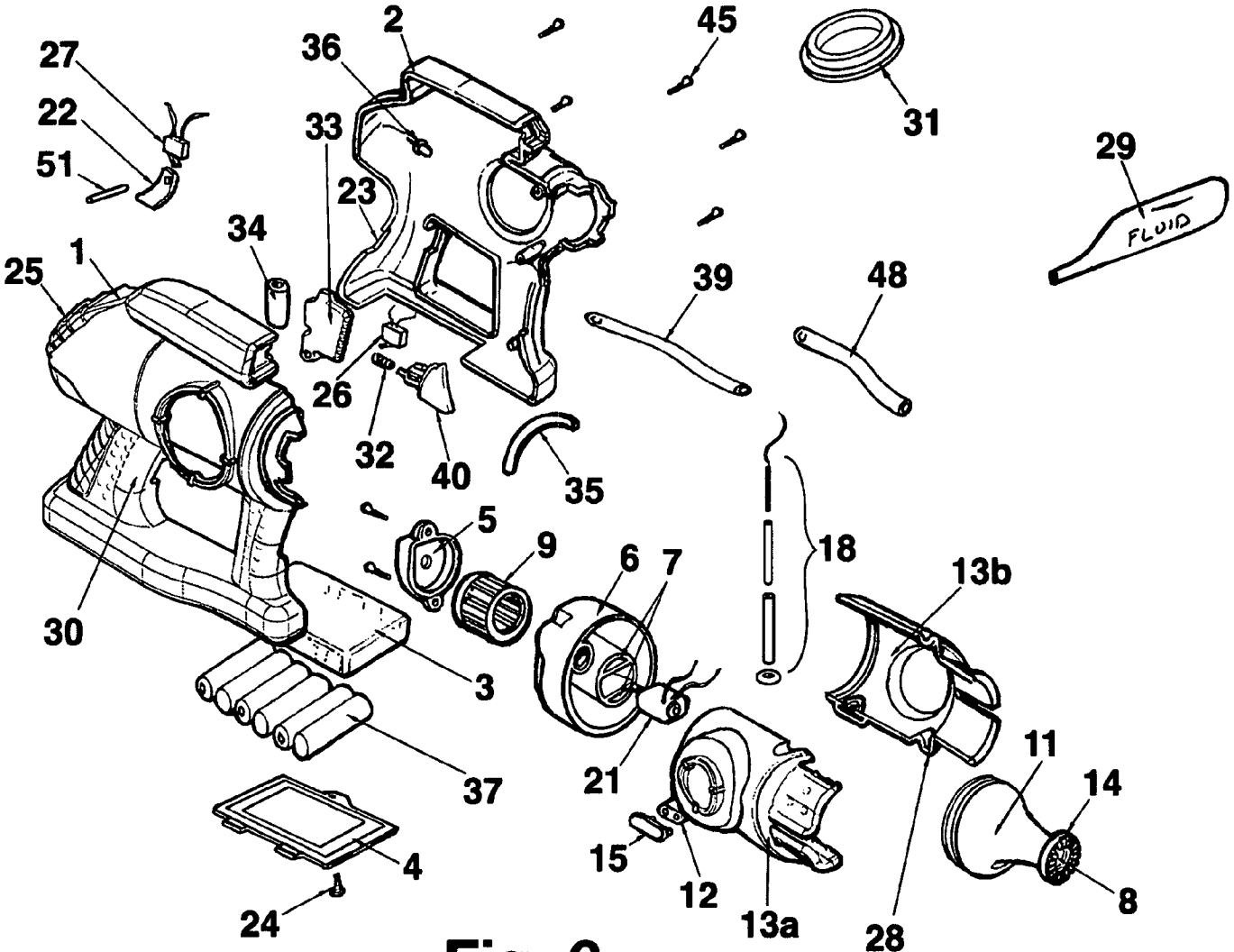
FIG. 6 shows an exploded perspective view of a fog filled bubble blower.
Figure 9:
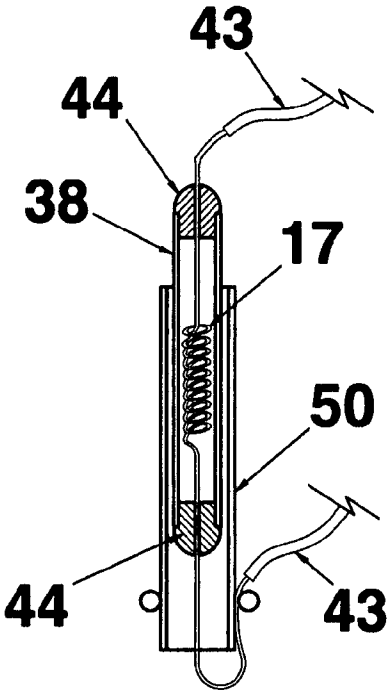
FIG. 9 shows a sectional view of a heater assembly along the line C–C'in FIG. 8.
Figure 8:
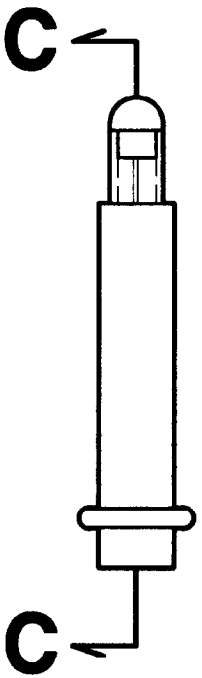
FIG. 8 shows an assembled view of a heater assembly.
Figure 7:
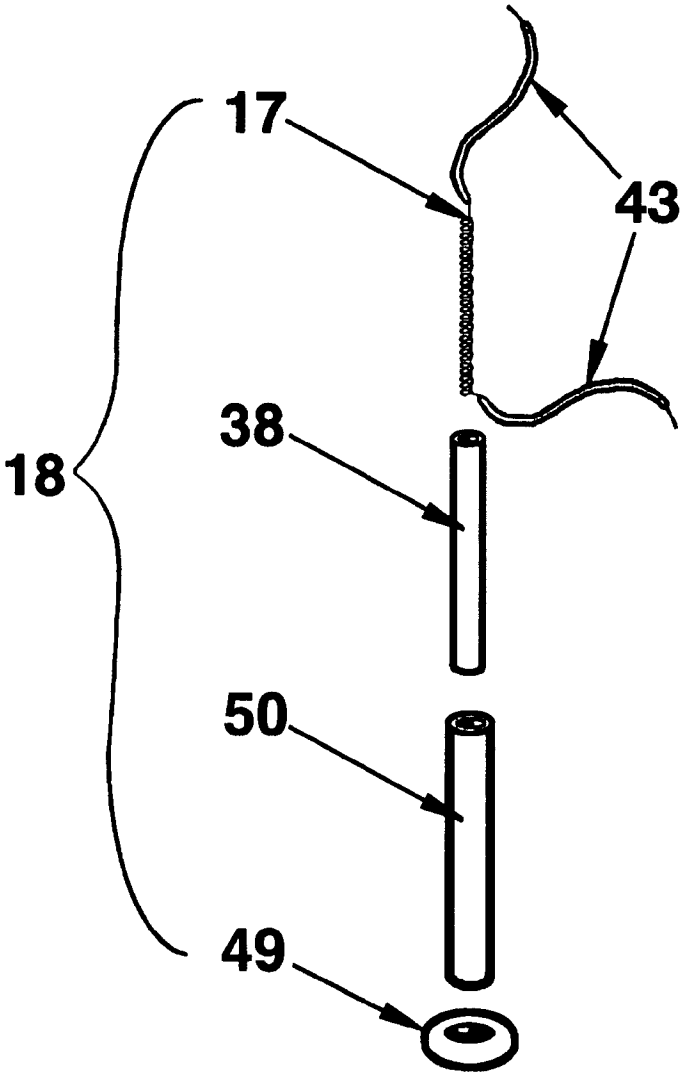
FIG. 7 shows an exploded view of a heater assembly.

As shown in FIGS. 1, 5 & 6, the fog filled bubble blower 47 is comprised of a housing having a housing front 1 and housing back 2, which housing contains or is attached to a battery box 3, exhaust fan 9, fog fluid reservoir 12, fog chamber 13, heating element assembly 18, electric motor 21, nozzle 11 and bubble wand 14, and switching circuits to operate the electric motor and heating element assembly. The housing also has a nozzle mounting area 28 where the nozzle attaches to the housing. Generally, and as is more specifically described below, fog fluid is placed in the fog fluid reservoir, which fog fluid reaches the heating element assembly 18, where it is vaporized in the fog chamber 13*a* & 13*b*. The bubble wand 14 is dipped into bubble solution, the exhaust fan is activated, sucking the fog out of the fog chamber and through the nozzle 11 and out through the bubble wand. As the fog filled air passes through the wand, it forms fog filled bubbles 46.

As shown in FIGS. 5 & 6, the battery box 3 has a battery box cover 4 for covering the battery box and to assist in retaining batteries 37 in the battery box. This embodiment uses 6 AAA batteries in series. The batteries are electrically connected in two switched circuits, the electric motor circuit and the heating element assembly circuit.

The heating element assembly circuit is switched by the heating element on/off switch 27, which in the preferred embodiment, will not stay in the on position unless pressure is applied by the user, a well-known device commonly referred to as a dead-man's switch. In the preferred embodiment, the heating element on/off switch is located in the housing so that when the toy is held, the switch is on, but off when the toy is resting out of the user's hand. As shown in FIG. 5, the user's hand will engage on/off switch cover 22 in turn activating switch 27 when the bubble blower is ordinarily picked up by the housing handle area 30. This construction is energy efficient because the heating element assembly 18 will not operate when the bubble blower is resting out of the user's hand. The preferred embodiment also has an LED or other similar light 36 mounted in the housing and electrically connected to the heating element circuit, so that the light is switched on and off with the heating element circuit. The light advises the user the heating element circuit is on, and improves the aesthetic enjoyment of the fog filled bubble blower 47.

The exhaust fan motor circuit preferably includes a spring 32 biased fan momentary switch 26, which intermittently switches on the electric motor 21 and exhaust fan 9 when the user depresses the fan momentary switch cover 40. As with the heating element on/off switch 27, the fan momentary switch requires continued pressure by the user to stay in the on mode, which also conserves energy.

Figure 2:
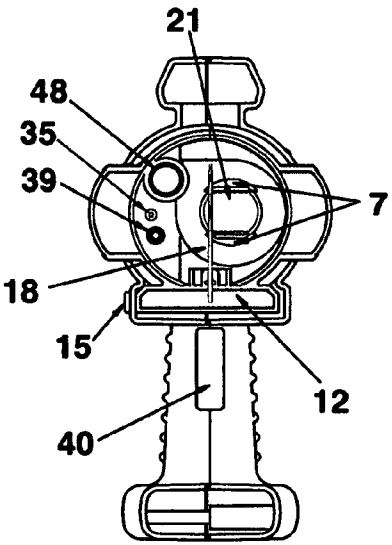
FIG. 2 shows a sectional view of a fog filled bubble blower along the line A–A' in FIG. 1.
Figure 4:
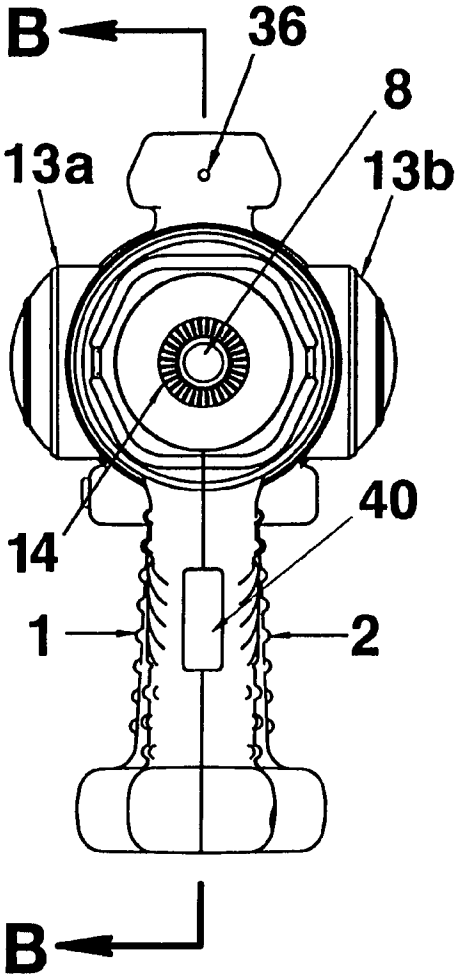
FIG. 4 shows a view of the front of the fog filled bubble blower.
Figure 11:
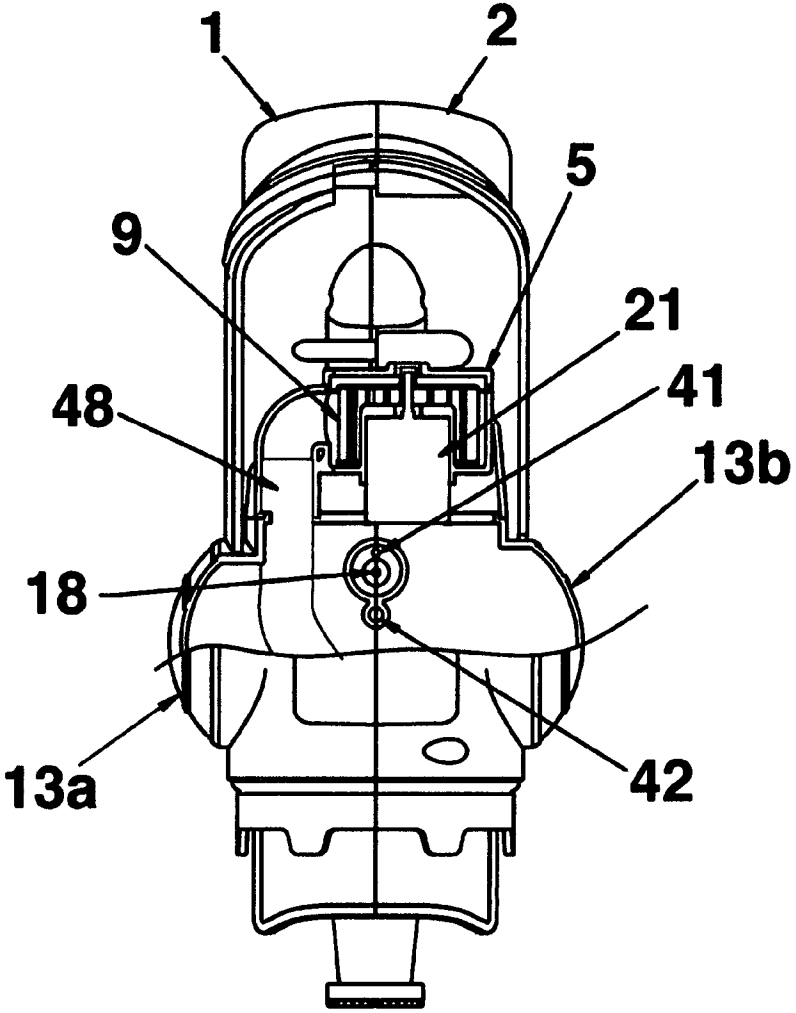
FIG. 11 shows a sectional view of a fog filled bubble blower along the line D–D' in FIG. 10.
Figure 10:
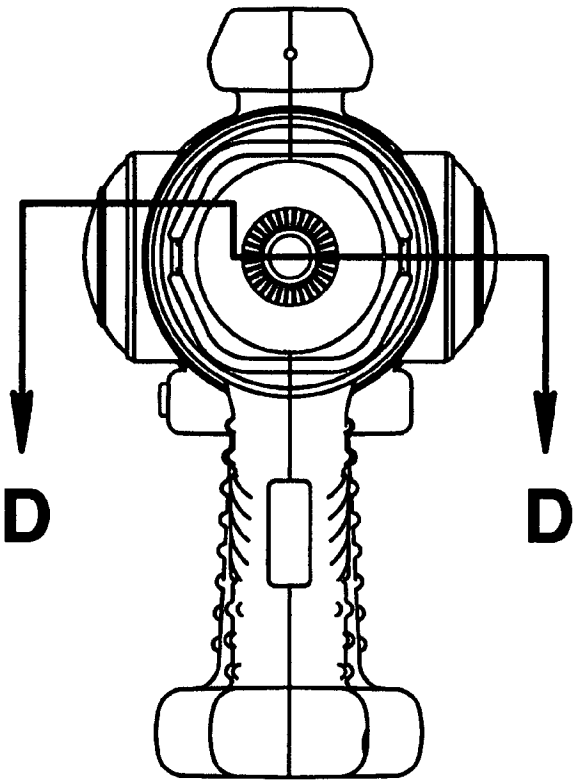
FIG. 10 shows a front view of a fog filled bubble blower.

As shown in FIGS. 5, 6 & 11, in the preferred embodiment, fog is evacuated from the fog chamber 13*a* & 13*b*, by suction rather than the more traditional positive pressure blowing. Fog is formed in the fog chamber, which fog is sucked out of chamber directly through air intake vents 7, see FIGS. 2 & 6, in the exhaust fan housing front 6. As shown in FIGS. 11 & 5, the fog is then forced by positive pressure from the exhaust fan 9 through an exhaust feed hose 48 to the nozzle 11, and then to and through the exhaust port of the bubble wand 14, see FIGS. 4 & 5.

Figure 3:
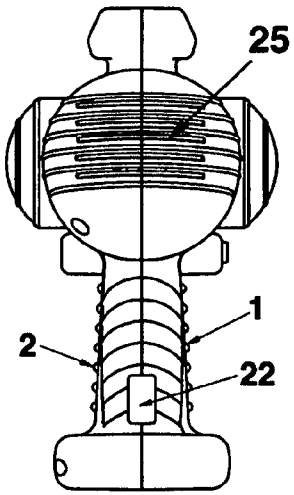
FIG. 3 shows a view of the back of the fog filled bubble blower.

This air flow using suction to evacuate the fog chamber is more efficient and delivers a higher concentration of fog per volume of air than traditional blowers, since less unfogged air is introduced into the exhaust feed hose. This efficient process is facilitated by a fresh air intake hose 39, shown in FIGS. 5 & 2, which draws fresh air through housing intake vents 25, shown in FIG. 3, and passes the air through the exhaust fan housing front 6 and to the end of the chamber 13*a* & 13*b* away from the air intake vent 7. As fog is sucked by the exhaust fan, fresh air refills the fog chamber, but does so away from the exhaust fan so that a greater amount of fog is evacuated before it is materially diluted by fresh air. This makes for denser fog and a more enjoyable fog filled bubble. The path of the fog from fog chamber 13*a* & 13*b*, through the exhaust fan 9 and exhaust feed hose 48 and out the exhaust port 8, will be substantially not in air communication with the outside air, except for fresh air entering the fog chamber through the fresh-air intake hose 39 and the air opening at the exhaust port 8. Generally, fresh air will not enter the exhaust port 8 because the pressure from the exhaust fan 9 will drive the air out of the exhaust port 8. An air feed hose mount 42 attached to or a part of the housing front 1 or back 2 can be used to support the fresh air intake hose.

A variety of heating element assemblies will work. The preferred embodiment of the heating element assembly 18 is the device disclosed in FIGS. 6, 7, 8 & 9, and having heating element wire leads 43, a nichrome heating element 17, a glass tube 38, a stainless steel tube 50, and an o-ring 49 to serve as a seal between the fog chamber 13*a* & 13*b* and the fog fluid reservoir 12. The glass tube is sealed with epoxy 44.The efficiency of this heating element assembly is improved by pressurizing the reservoir using an air feed button 33 to press an air feed bladder 34, which pressurizes the fog fluid reservoir 12 through an air feed hose 35. Alternatively, the heating element assembly and pressurizing method can be as disclosed in U.S. Pat. No. 6,421,502 to Aronie, or the heating element assembly could be a variety of other known fog generating heating element assemblies.

The fog chamber 13*a* & 13*b* has an overflow drain hole 41 for draining fog fluid that condenses in the fog chamber, and the fog filled bubble blower has an overflow tank 52 to store the excess and condensed fog fluid that otherwise could accumulate in the fog chamber or near the heating element assembly. The fog fluid reservoir preferably has a removable reservoir fill cap 15 to permit filling the fog fluid reservoir 12. In the preferred embodiment, the overflow tank 52 and the fog fluid reservoir are adjacent, and the reservoir fill cap 15 also serves as an overflow tank cap. The fog chamber 13*a*, 13*b* preferably is made of a transparent material so the user can see the fog form in the fog chamber to improve the aesthetic and amusement effects of the toy. The housing front 1 and back 2 preferably are attached to each other by screws 45, just as the exhaust fan housing back 5 and is attached to the front 6, the battery box cover also is attached to the battery box by a screw 24. The switch covers, 22 & 40, and button may be mounted in conventional ways, such as hinged on a pin 51 or friction fit in the housing front and back. On/off switch cover projects through the housing front 1 and housing back 2 through a switch opening 23.

The user switches on the heating element on/off switch 27, which electrically connects batteries in the battery box 3 to the nichrome wire heating element 17, which vaporizes fog which collects in the fog chamber 13*a* & 13*b*. The heating element assembly can be a variety of fog generating heating assemblies, including the assembly 18, shown in FIG. 13, having a foam reservoir sponge 20, in fluid connection to the fog fluid reservoir 12 and nichrome wire heating element 17 mounted on a mica board 16, and a fiberglass wick 19 connecting the reservoir foam sponge and nichrome heating element. Alternatively, the heating element assembly 18 could be the pressurized system disclosed in U.S. Pat. No. 6,421,502 Aronie, or other known fog generating systems.

Figure 12:
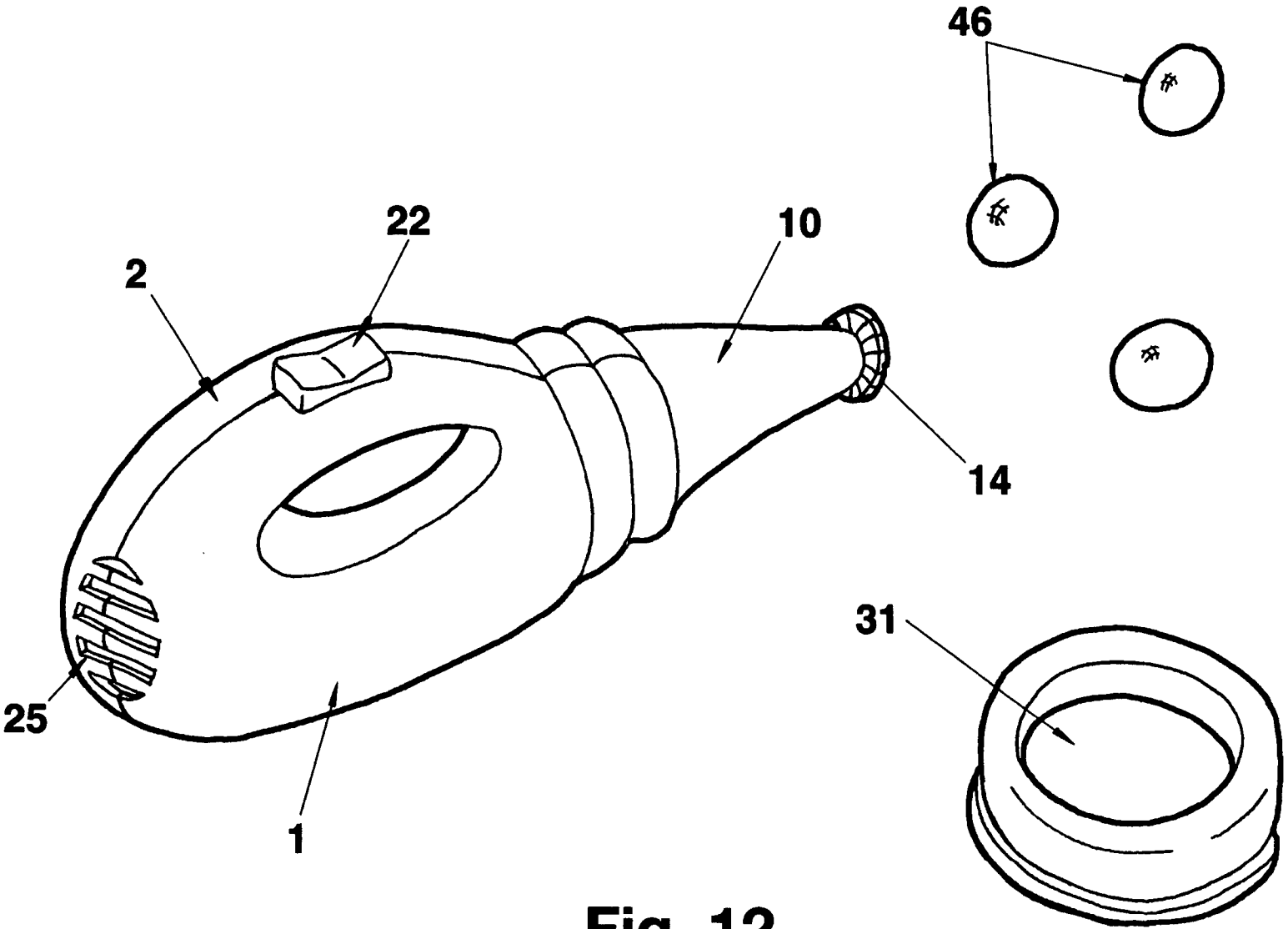
FIG. 12 shows a perspective exploded view of an alternative fog filled bubble blower with bubbles and dipping tray for illustrative purposes.
Figure 13:
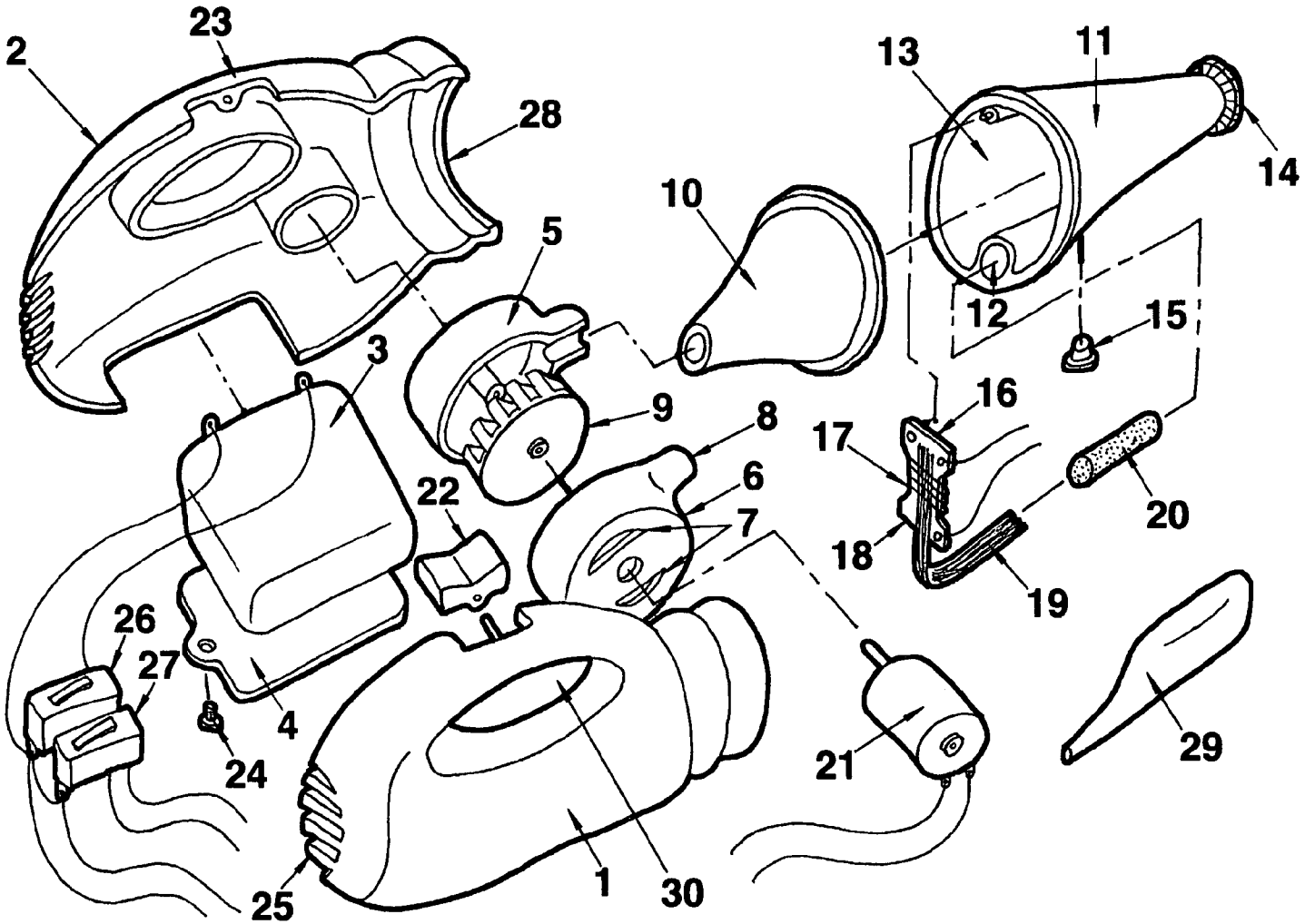
FIG. 13 shows a perspective exploded view of an alternative fog filled bubble blower.

In the alternative embodiment of the fog filled bubble blower shown in FIGS. 12 & 13, the invention has a decorative and functional housing made of two components, housing front 1 and housing back 2, which are fastened together such as with screws or glue, to orient, secure, and contain the components, comprising: a battery box 3, which is trapped and secured with mating rib structures between housing halves 1 & 2; a battery box cover 4, which is snapped and screwed to battery box 3 with battery box cover screw 24; a fan momentary switch 26, which is press fit to mounting pins in housing front 1; a heating element on/off switch 27, which is press fit to mounting pins in housing front 1; an on/off switch cover 22, which is pivotally mounted to a steel pin and trapped between housing halves 1 & 2; an exhaust fan housing back 5, which is press fit to housing back 2; an exhaust fan 9, which is loose fit to allow free axial rotation within exhaust fan housing back 5; an exhaust fan housing front 6, which is press fit to exhaust fan housing back 5; an electric motor 21, which mounts to the exhaust fan 9 via press fit on shaft end, the motor mounting to housing front 1 with appropriately shaped ribbing; an exhaust feed-cone 10, which is press fit to exhaust port area of the exhaust fan housing back 5 and exhaust fan housing front 6, which cone is also permanently trapped between housing front 1 and housing back 2; a nozzle 11, which mates face to face with exhaust feed-cone 10 and is permanently trapped between housing front 1 and housing back 2; a mica board 16, which is permanently fixed to nozzle 11 via mounting pins and secondary manufacturing process; a fiberglass wick 19, which is placed over mica board 16; a nichrome wire heating element 17, which is wound around mica board 16 and fiberglass wick 19; a foam reservoir sponge 20, which is pressed into smoke fluid reservoir 12 with free-end of fiberglass wick 19; and a reservoir filler cap 15, which is press fit to the nozzle 11.

Fog fluid contained in fluid reservoir 12 is fed to heating element via fiberglass wick 19. Depressing smoking unit on/off switch 27 activates wire heating element 17 and begins vaporization process. The user dips bubble-wand 14 into bubble solution tray 31 to build up a light bubble solution film over exhaust port. Vapor, "smoke" or "fog" collected in the smoke chamber 13 is evacuated and forced forward by an electric motor 21 and exhaust fan 9, which are operated by depressing the fan momentary switch 26 located in handle area 30. The vapor filled air fog is forced under pressure from the nozzle 11 and dispersed through the bubble wand 14, forming a smoke or fog filled bubble.

As the heating element assembly heats the fog fluid, the fog chamber 13 fills with fog. The user then dips the wand 14 in bubble solution, contained in a bubble tray 31, as shown in FIG. 12, containing a bubble solution or soap solution, to coat the bubble wand in well-known manner. The fan momentary switch 26, activated by the on/off switch cover 22, electrically connects the batteries to the electric motor 21, which turns the exhaust fan 9.

The exhaust fan, as shown in FIG. 13, draws air through the housing intake vent 25, and blows the air through the exhaust feed-cone 10. The exhaust fan, exhaust feed-cone and nozzle 11 form an enclosed unit not open to outside air, except through the air intake vents 7 and at the bubble wand 14, to permit the efficient conveyance of air to the wand 14. The nozzle 11 also is tapered to efficiently focus the air flow to the wand, and efficiently trap the generated fog.

Energy efficiency is improved by the use of an on/off switch cover 22, which operates the fan momentary switch 26 and heating element on/off switch 27. If the user releases the on/off switch cover 22, both fan momentary switch 26 and heating element on/off switch 27 return to the off mode, which conserves energy.

Possible applications include, but are not limited to, holiday specific toys, such as for Halloween. The invention also would be used for home entertainment, and commercial applications, such as smoking bubble wedding blowers, disco lights, toy trains, fire trucks, smoking bubble exhaust for children's ride-on toys, discovery and learning type toys, bicycle mounted smoking bubble blowers, hand-held bubble blowers, and bubble solution cap toppers, which is a unit retrofitted directly to bubble bottle.

Obviously, many modifications and variations of the present invention are possible in light of the above teachings. It is, therefore, to be understood that within the scope of the present application, the present invention may be practiced otherwise than as specifically described.

I claim:

1. A fog filled bubble blower comprising:

a housing attached to a battery box, exhaust fan, fog fluid reservoir, fog chamber, heating element assembly, electric motor, nozzle, and bubble wand, and having switching circuits to operate the electric motor and the heating element assembly, so that when fog fluid from the fog fluid reservoir reaches the heating element assembly, the fog fluid is vaporized in the fog chamber, and when the bubble wand is dipped into bubble solution, and the exhaust fan is activated, fog is sucked out of the fog chamber and forced through the nozzle and through the bubble wand, forming a bubble which is filled with fog, in which fresh air enters the fog chamber through a fresh air intake hose, so that the heating element assembly is between the fresh air entering the fog chamber and the exhaust fan.

2. The fog filled bubble blower of claim 1 in which fresh air enters the fog chamber through a fresh air intake hose that does not pass fresh air through the exhaust fan before the fresh air enters the fog chamber.

3. A fog filled bubble blower comprising:

a battery box, an exhaust fan, a fog fluid reservoir, a fog chamber, a heating element assembly, an electric motor, and a bubble wand, so that when fog fluid from the fog fluid reservoir reaches the heating element assembly, the fog fluid is vaporized in the fog chamber, and when the bubble wand is dipped into bubble solution, and the exhaust fan is activated, fog is forced through the bubble wand, forming a bubble which is filled with fog, where the heating element assembly is located between fresh air entering the fog chamber and the exhaust fan, wherein fresh air enters the fog chamber through a fresh air intake hose.

4. A fog filled bubble blower comprising:

a battery box, an exhaust fan, a fog fluid reservoir, a fog chamber, a heating element assembly, an electric motor, a fresh air intake hose to deliver fresh air to the fog chamber, and a bubble wand, so that when fog fluid from the fog fluid reservoir reaches the heating element assembly, the fog fluid is vaporized in the fog chamber, and when the bubble wand is dipped into bubble solution, and the exhaust fan is activated, fog is forced through the bubble wand, forming a bubble which is filled with fog, where fresh air enters the fog chamber through the fresh air intake hose that does not pass fresh air through the exhaust fan before the fresh air enters the fog chamber.

* * * * *